US005201693A

United States Patent [19]

Sparkes

[11] Patent Number: 5,201,693

[45] Date of Patent: Apr. 13, 1993

[54] BABY BOUNCER

[75] Inventor: Curtis A. Sparkes, Altrincham, England

[73] Assignee: Lamondine S. A., Geneva, Switzerland

[21] Appl. No.: 694,493

[22] Filed: May 2, 1991

[30] Foreign Application Priority Data

May 2, 1990 [GB] United Kingdom ..... 9009923
Jun. 20, 1990 [GB] United Kingdom ..... 9013732

[51] Int. Cl.[5] ..... A63B 22/00; A61H 3/00
[52] U.S. Cl. ..... 482/69; 472/118
[58] Field of Search ..... 482/23, 69, 77, 74; 297/463; 472/32, 34, 39, 118

[56] References Cited

U.S. PATENT DOCUMENTS 2,478,004 8/1949 Newell ..... 482/69
3,761,082 9/1973 Barthel ..... 482/69
4,492,374 1/1985 Lekhtman et al. ..... 482/77

*Primary Examiner*—Stephen R. Crow
*Attorney, Agent, or Firm*—Burns, Doane, Swecker & Mathis

[57] ABSTRACT

A baby bouncer apparatus includes a spring which is adapted in use to be suspended from an overhead suspension arrangement, and a harness for holding the baby which is suspended below the spring. The spring comprises an elongate cantilever spring arrangement disposed transverse relative to the overhead suspension and relative to the direction in which load is to be applied. The harness is suspended from respective end regions of the cantilever spring arrangement.

17 Claims, 2 Drawing Sheets

BABY BOUNCER

FIELD OF THE INVENTION

This invention concerns a baby bouncer, that is to say apparatus for overhead suspension and for support of a baby or very young child in such a way that he/she is capable of bouncing up and down.

BACKGROUND OF THE INVENTION

Present commercially available baby bouncer apparatus generally comprises means for clamping over a door lintel, such as slidably or pivotally connected jaw elements, or else a ceiling mounted hook, and, attached thereto, optionally by way of a non-extensible connector, such as a chain, an elongate tension spring, usually a helical spring, but occasionally a strip of rubber or the like, which in use is arranged vertically and is extensible vertically, in the direction in which load is applied. Attached to the other end of the spring, again optionally by way of an inextensible connector, is a transverse bar, from the extremities of which, a harness for the baby is suspended by way of respective lines, such as cords, ropes or chains. The harness generally comprises a portion which fits between the baby's legs and a portion which fits around his/her waist. It may be relatively rigid, in the manner of a seat, or relatively flexible, in the manner of a belt, with a looped lower piece to fit between the legs.

In use, the bouncer apparatus should be so arranged that the baby, when seated or strapped into the harness, is able to stand with his/her feet in contact with the ground, but the suspension means should be of such length and the spring of such tension, that, at rest, the baby is properly supported and is not in a position of having bent knees with feet flat on the ground. The baby should then be able to exert positive downward force by bending his/her legs so as to extend the spring, which will then react, when that force is released, by reducing in length and permitting upward bouncing of the baby. In this respect, it will be appreciated that the purpose of the apparatus, in addition to providing an enjoyable activity for the baby, while it is safely retained (i.e. incapable of crawling about with all the risks that involves), is to develop the strength of the baby's legs, as well as general co-ordination in an upright position as a precursor to walking.

Problems can arise in three areas in relation to the known commercial baby bouncers. Firstly, in respect of the overhead fixing, clamping may not be sufficiently secure, particularly if the lintel does not provide a wide ledge to engage over, and the alternative of a hook means a permanent fixing position, and a permanent fixture, which cannot be removed without repair being necessary. Secondly, the tension of the spring is critical to satisfactory operation of the bouncer, and this may prove inadequate, or start to fail after prolonged use. Thirdly, and this is connected also to the matter of spring tension, the height available between the overhead fixing (lintel or ceiling hook) and the harness may often prove inadequate, and this puts constraints on the spring, which then cannot be too long and must have a relatively high co-efficient of tension (elasticity).

SUMMARY OF THE INVENTION

The object of the present invention is to propose a modified design of a baby bouncer which should obviate at least some of the problems outlined above.

According to the invention the baby bouncer apparatus comprises elongate cantilever spring means arranged transversely relative to its overhead suspension means and relative to the direction in which load is to be applied thereto, a harness for a baby being suspended from respective end regions of the cantilever spring means.

In use, the suspension means, which may consist of an inextensible metal chain, hangs vertically, whilst the cantilever spring means extends crosswise, i.e. generally horizontally. When the baby is installed in the harness, load is applied in a downward direction and the end regions of the cantilever spring means, to which the harness is attached, flex downwards, resiliently, so the spring means takes on a bowed shape. The resilience of the spring means permits bouncing of the baby in the same way as with previous bouncer devices, without the need for any vertically arranged spring element, which may take up too much of the limited headspace. In other words, by using a transverse cantilever spring means, the amount of headspace available is no longer critical to successful operation of the bouncer.

The cantilever spring means, which conveniently consists of a single elongate element, such as a metal bar or strip, effectively constituting a leaf spring, is thus able to take the place and take on the combined functions of the previous vertically hanging spring means (helical spring or resilient block) and non-flexible transverse bar for suspension of the harness.

It is particularly advantageous in practical embodiments of the invention for the cantilever spring, at rest, to have a curved, preferably a symmetrically bowed, configuration such that its end regions, to which the harness lines are attached are higher (i.e. further from the harness) than its central region. In this respect, the chosen initial curvature of the cantilever spring is preferably equal, but opposite to its maximum downward flexure in its fully loaded condition (whether or not limited by any support means).

Ideally, the spring tension of the cantilever spring is selected so that in the initial unloaded condition of the apparatus, the end regions of the spring extend at a predetermined upward inclination so that when a baby is placed in the harness, but is inactive (i.e. only its weight acts on the spring), the end regions of the spring flex downwards substantially to the same level as the central region (i.e. the spring becomes substantially straight and substantially horizontal). Then, only when additional downward force is applied do the end regions of the spring flex downwards and upon release flex back to enable bouncing.

The aforesaid initial upward curvature of the end regions of the transverse cantilever spring means maximises the deflection which can occur in the vertical direction and enhances the effectiveness of the spring so that the most efficient use is made of the available space.

Also, in advantageous embodiments of baby bouncer, within the scope of the invention, substantially non-flexible support means is provided beneath the cantilever spring means, i.e. at the side of the spring means from which the harness is suspended, so as to limit the deflection of the end regions of the spring means. The construction of such support means should be carefully chosen to allow adequate flexure of the spring means for bouncing, but prevent excessive flexure, which might be brought about by too great a load being applied to the harness and could result if failure of the spring means. Thus, the support means is an important safety measure, substantially eliminating any risk of spring failure, which, if it occurred, could seriously injure the baby in the harness.

The support means advantageously takes the form of an arcuate bar. In this respect, the curvature of the support bar advantageously matches the chosen maximum flexed curvature of the spring means, so as to provide support over at least a large portion of the length of the spring at the limiting flexed position.

A further optional development in some embodiments of the bouncer of the invention is the provision of a free standing/self supporting frame to which the suspension means of the apparatus can be mounted. This obviates the need to have a doorway, or gateway of adequate height to accommodate the bouncer apparatus, and more importantly means that the location of the bouncer can be freely chosen and varied to suit the user, without any constraint owing to the position of a fixed overhead hook or the like, or of a doorway.

Such a frame conveniently comprises an upright generally inverted U-shaped portion, with respective limbs joined by an upper cross piece, supported upon a base portion, which may likewise have a U-shaped configuration or a closed, four sided configuration, and is intended to lie flat on the ground or floor. The upright portion is conveniently readily detachable from the base portion, for ease of storage and assembly. In this respect, the base portion is advantageously provided with respective sockets into which the lower ends of the limbs of the upright portion fit or respective spigots over which the end portions of the upright limbs will fit. Height adjustment is also a possibility by telescopic adjustment of the upright end portions relative to the sockets or spigots e.g. by lock nuts or the like engaging into selected apertures of a series of apertures provided in each component.

The upright and base portions of the frame are conveniently formed of tubular metal, e.g. aluminium or steel.

The crosspiece of the upright portion conveniently has a hook midway along its extent for attachment of the suspension areas of the remainder of the bouncer apparatus.

BRIEF DESCRIPTION OF THE DRAWING FIGURES

A particular practical embodiment of the bouncer apparatus of the invention will now be described, with reference to the accompanying drawings, in which.

DETAILED DESCRIPTION OF THE PREFERRED EMBODIMENTS

Figure 1:
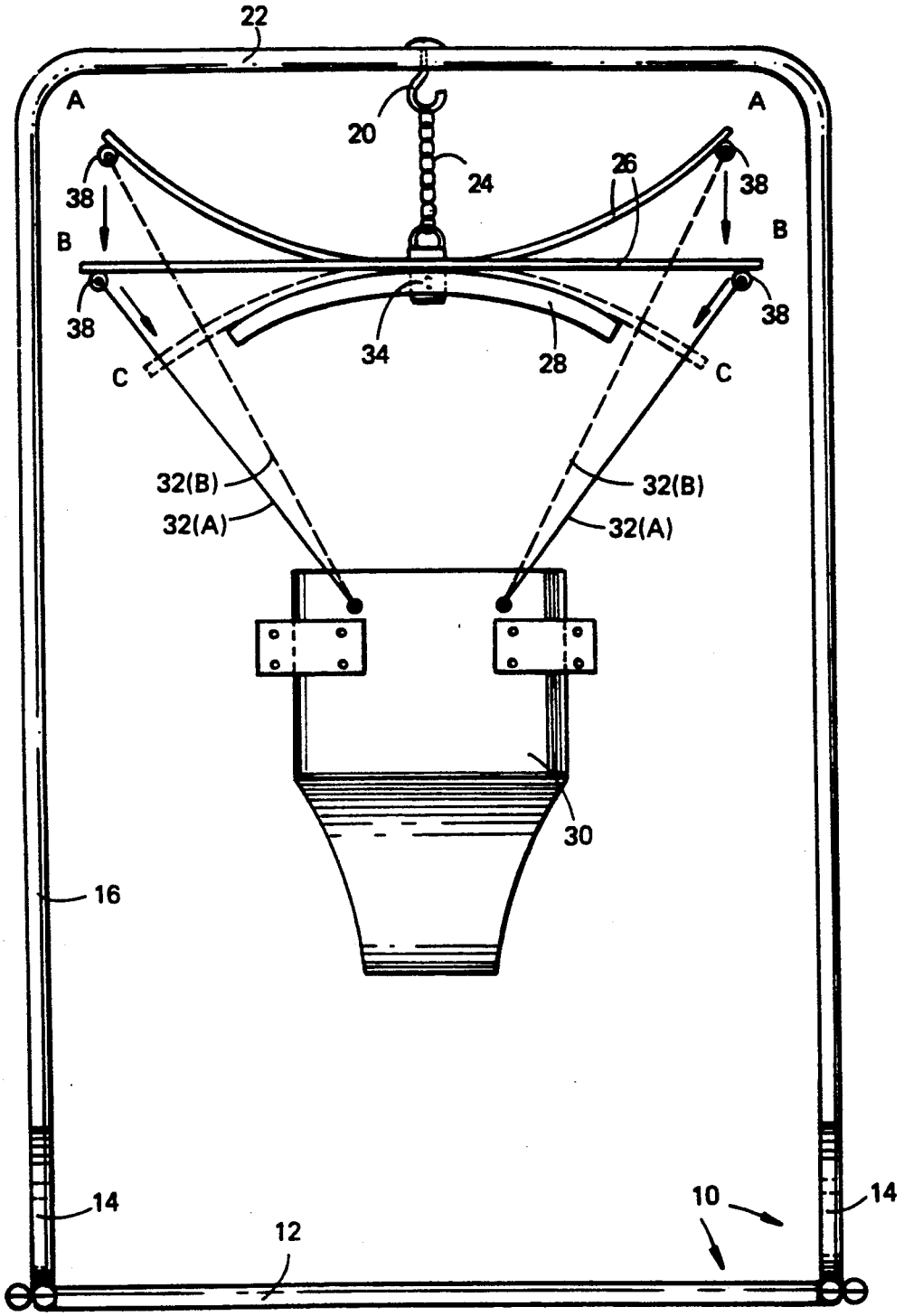
FIG. 1 is a schematic front view of this embodiment of bouncer.
Figure 2:
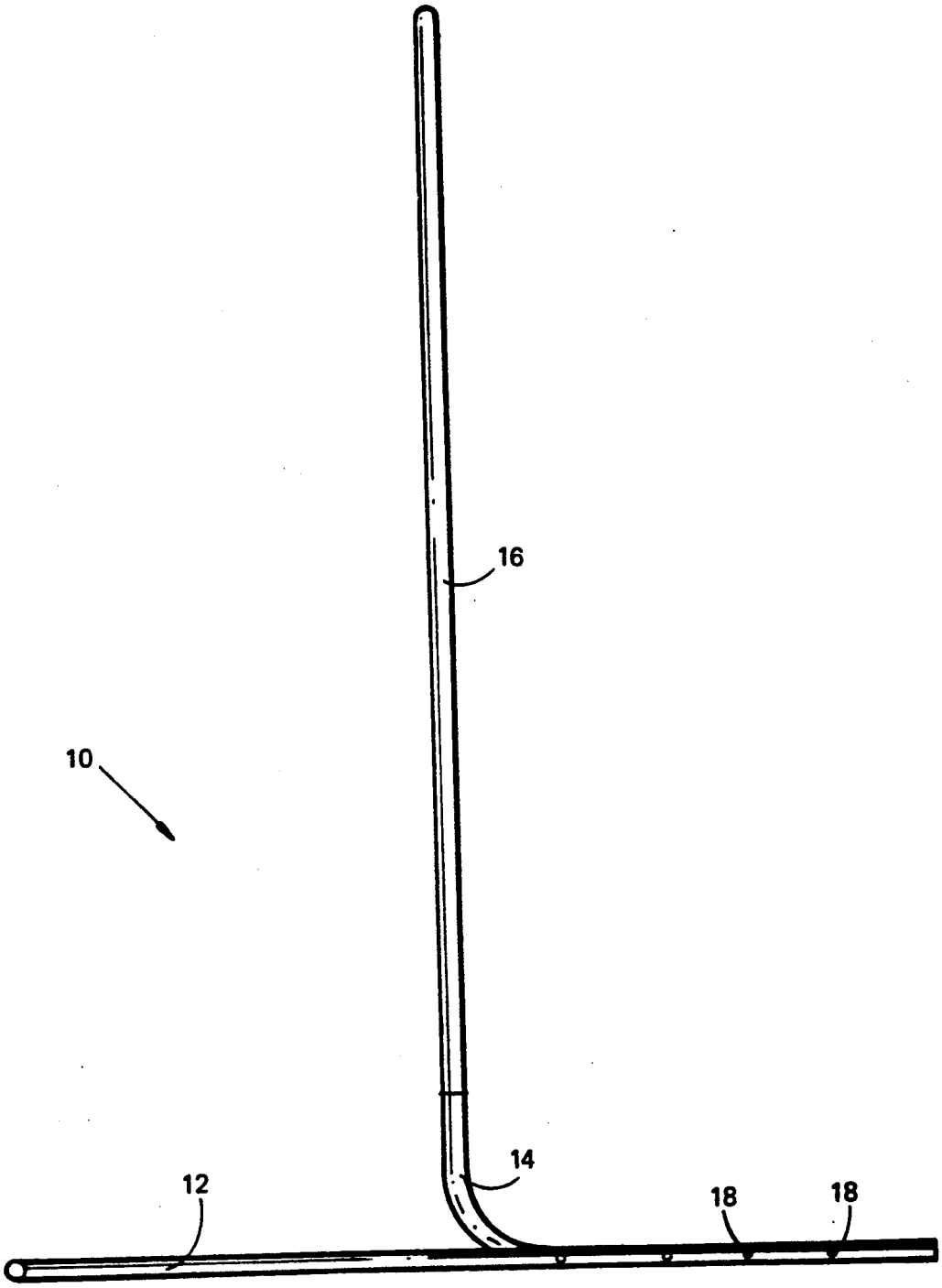
FIG. 2 is a schematic side view of the frame alone.

As illustrated, the apparatus comprises a frame, designated generally by reference numeral 10, and a bouncer which is suspended therefrom. These may be sold separately, or together.

The frame 10 comprises a U-shaped base portion 12 of tubular metal provided approximately midway along each side limb with respective, upwardly curving sockets 14, and a U-shaped upright portion 16, also of tubular metal. The sockets 14 are simply bolted to the insides of the side limbs of the base 12 and their positions can be varied by fixing them by way of alternate holes 18 provided along the limbs. The ends of the limbs of the upright portion 16 are inserted into the sockets 14 and additional, releasable fastening means may be provided. A hook 20 is connected to the upright portion 16, approximately midway along its crosspiece 22, so as to project downwardly in the erect condition of the frame 10.

It will be appreciated that the frame 10 can readily be assembled from the component parts, namely base portion 12, sockets 14, upright portion 16, hook 20, and relevant bolts and/or other fastener means and placed at any desired position, and also readily dismantled and packed flat for storage.

The suspensible bouncer apparatus comprises suspension means in the form of a metal chain 24, a transversely arranged cantilever spring 26, in the form of an elongate steel strip of bowed configuration, a transverse support bar 28, immediately below the spring 26, and a harness 30 (for a baby) suspended by two cords or ropes 32 which are attached adjacent the respective ends of the spring 26.

The spring 26 is, in this preferred embodiment, approximately 60 cm long and 2 cm wide. It is attached at approximately its mid point to the suspension chain 24, by way of a connector 34, so that, when suspended and without load, its end regions extend at an upward inclination. In this respect, the spring 26 is shown in three positions in FIG. 1, the unloaded position being indicated by reference letter A. At its ends the spring 26 is provided with eyelets 38 for connection of the ropes 32.

The spring 26 is selected to have appropriate initial curvature and springe characteristics for downward flexure of its end regions to positions B and C, as indicated in FIG. 1, and for bouncing of the baby as already described in the introduction hereto. Position B represents the loaded condition of the spring 26, when the baby is placed in the harness 30 but is inactive. The configuration of the spring under these conditions depends entirely on its spring characteristics and on the size of the load applied, but generally it should be approximately straight, i.e. horizontal. Position C represents the maximum downward flexure of the end regions of the spring 26, and would normally be achieved only during bouncing. In FIG. 1 position C is in broken lines and the harness lines are not shown.

The support bar 28 is of substantially rigid (non-flexible) material and is mounted by way of the connector 34 in alignment with the cantilever spring 26 so that its middle region is immediately below the central region of the spring 26. Indeed, the central region of the spring 26 ideally rests upon the central region of the support bar 28. The support bar 28 is, however, arcuate, its end regions being curved downwardly, as indicated, so that, in the unloaded condition A of the spring 26 and also when the spring 26 is loaded to position B, i.e. such as to extend substantially horizontally, there is an increasing gap between the bar 28 and the spring 26 towards the respective ends thereof.

When a baby is installed in the harness 30, its weight, acting via the ropes 32, causes flexure of the spring 26 from position A with upwardly extending end regions to position B where the end regions have been brought down approximately to the level of the central region. Upon application of further downward force the end regions of the spring flex downwards, maximum permissible downwards flexure being defined by position C where the spring 26 contacts and rests upon the bar 28. When the additional downward force is released, bouncing of the baby ensues aided by return of the spring 26 to straight configuration or upward flexure, and continued oscillation.

It will be noted that the bar 28 is somewhat shorter than the spring, but that is not essential.

The advantages of the cantilever spring, support bar and dismantable frame have already been explained in the introduction, the transversely extending cantilever spring being especially important in taking the place of previous vertically hanging spring means and separate transverse bar for harness suspension, yet requiring far less head space for effective operation. In this respect, difficulties in successful operation of previous forms of bouncers have frenquently arisen owing to limited headspace, such that modifications are needed before the baby is correctly positioned for beneficial bouncing activity.

It should be understood that the above described embodiment is merely illustrative and not limitative of the scope of the invention. Many variations are possible, and some of these possibilities are hinted at or obvious from the general discussion preceding the specific embodiment.

I claim:

1. A baby bouncer apparatus comprising: a spring; overhead suspension means for suspending the spring, said spring being connected to the overhead suspension means; and a harness for receiving a baby which is suspended below the spring, said spring comprising elongate cantilever spring means having oppositely positioned end regions, said cantilever spring means being arranged transversely relative to the overhead suspension means and relative to the direction in which load is to be applied thereto, the harness being suspended from the respective end regions of the cantilever spring means.

2. A baby bouncer according to claim 1, wherein the overhead suspension means comprises an inextensible metal chain.

3. A baby bouncer according to claim 1, wherein the elongate cantilever spring means is a leaf spring.

4. A baby bouncer according to claim 2, wherein the elongate cantilever spring means is a leaf spring.

5. A baby bouncer according to claim 2, wherein the elongate cantilever spring means includes a central region disposed between the end regions, said elongate cantilever spring means having a curved profile under conditions of no load, such that its end regions, to which the harness is attached, are higher than its central region.

6. A baby bouncer according to claim 3, wherein the elongate cantilever spring means includes a central region disposed between the end regions, said elongate cantilever spring means having a curved profile under conditions of no load, such that its end regions, to which the harness is attached, are higher than its central region.

7. A baby bouncer according to claim 4, wherein the elongate cantilever spring means includes a central region disposed between the end regions, said elongate cantilever spring means having a curved profile under conditions of no load, such that its end regions, to which the harness is attached, are higher (i.e., further from the harness) than its central region.

8. A baby bouncer according to claim 5, wherein the curvature of the elongate cantilever spring means under conditions of no load is equal, but opposite to, its maximum downward flexure in its fully loaded condition.

9. A baby bouncer according to claim 5, wherein the spring tension of the elongate cantilever spring means is selected so that when a baby is placed in the harness, but is inactive, the end regions of the spring flex downwardly substantially to the same level as the central region so that the spring is substantially straight.

10. A baby bouncer according to claim 8, wherein the spring tension of the elongate cantilever spring means is selected so that when a baby is placed in the harness, but is inactive, the end regions of the spring flex downwards substantially to the same level as the central region so that the spring is substantially straight.

11. A baby bouncer according to claim 1, wherein substantially non-flexible support means is provided beneath the elongate cantilever spring means for limiting the downward deflection of the end regions of the spring means.

12. A baby bouncer according to claim 7, wherein substantially non-flexible support means is provided beneath the elongate cantilever spring means for limiting the downward deflection of the end regions of the spring means.

13. A baby bouncer according to claim 10, wherein substantially non-flexible support means is provided beneath the elongate cantilever spring means for limiting the downward deflection of the end regions of the spring means.

14. A baby bouncer according to claim 13, wherein the support means is an arcuate bar, said arcuate bar having a curvature that matches a maximum flexed curvature of the elongate cantilever spring means to provide support over at least a portion of the length of the spring.

15. A baby bouncer according to claim 1, wherein said overhead suspension means is connected to a free standing and self supporting frame.

16. A baby bouncer according to claim 7, wherein overhead suspension means is connected to a free standing and self supporting frame.

17. A baby bouncer according to claim 14, wherein overhead suspension means is connected to a free standing and self supporting frame.

* * * * *